US007484561B2

(12) United States Patent
Bridges

(10) Patent No.: US 7,484,561 B2
(45) Date of Patent: Feb. 3, 2009

(54) ELECTRO THERMAL IN SITU ENERGY STORAGE FOR INTERMITTENT ENERGY SOURCES TO RECOVER FUEL FROM HYDRO CARBONACEOUS EARTH FORMATIONS

(75) Inventor: Jack E. Bridges, Park Ridge, IL (US)

(73) Assignee: Pyrophase, Inc., Chicago, IL (US)

( * ) Notice: Subject to any disclaimer, the term of this patent is extended or adjusted under 35 U.S.C. 154(b) by 27 days.

(21) Appl. No.: 11/708,912

(22) Filed: Feb. 20, 2007

(65) Prior Publication Data

US 2007/0193744 A1 Aug. 23, 2007

Related U.S. Application Data

(60) Provisional application No. 60/774,987, filed on Feb. 21, 2006.

(51) Int. Cl.
*E21B 36/02* (2006.01)
*E21B 43/24* (2006.01)
*E21B 47/00* (2006.01)

(52) U.S. Cl. ..... 166/248; 166/60; 166/65.1; 166/66; 166/250.01; 166/302

(58) Field of Classification Search ..... 166/60, 166/64, 65.1, 66, 248, 250.01, 250.15, 272.1, 166/302

See application file for complete search history.

(56) References Cited

U.S. PATENT DOCUMENTS 4,140,180 A 2/1979 Bridges et al.
4,144,935 A 3/1979 Bridges
RE30,738 E 9/1981 Bridges
4,449,585 A 5/1984 Bridges
4,476,926 A 10/1984 Bridges
4,485,868 A 12/1984 Sresly et al.
4,485,869 A 12/1984 Sresty et al.
4,498,535 A 2/1985 Bridges
4,524,827 A 6/1985 Bridges et al.
4,538,682 A 9/1985 McManus et al.

(Continued)

OTHER PUBLICATIONS

"Electrically Enhanced Oil Recovery" by J.E. Bridges and S.E. Johansen, 2 pages (1995).

(Continued)

*Primary Examiner*—George Suchfield
(74) *Attorney, Agent, or Firm*—Nixon Peabody LLP

(57) ABSTRACT

The vast North American oil shale and tar sand deposits offer the potential to make USA energy independent. However, if these deposits were produced by the existing combustion processes, substantial CO2 emissions would be injected in to air. To avoid this green house gas problem and yet produce liquid fuels, an electro-thermal energy storage system that may be wind-powered is described. It stores the unpredictable, intermittent (e.g., wind) electrical energy over long periods as thermal energy in fossil hydrocarbon deposits. Because the thermal diffusion time is very slow in such deposits, the thermal energy is effectively trapped in a defined section of a hydrocarbon deposit. This allows time for the thermal energy to convert hydrocarbons into gaseous and liquid fuels. It can also use a portion of the fuel to regenerate electrical power into the electrical grid of higher energy content than was initially stored. In addition, the method can increase the reliability of the grid and provide a load leveling function.

19 Claims, 9 Drawing Sheets

U.S. PATENT DOCUMENTS 4,545,435 A 10/1985 Bridges et al.
4,570,715 A 2/1986 Van Meurs et al.
4,570,718 A 2/1986 Adams, Jr.
4,583,589 A 4/1986 Kasevich
4,660,636 A 4/1987 Rundell et al.
4,670,634 A 6/1987 Bridges et al.
4,704,514 A 11/1987 Van Egmond et al.
4,705,108 A 11/1987 Little et al.
4,790,375 A 12/1988 Bridges et al.
4,793,409 A 12/1988 Bridges et al.
4,817,711 A * 4/1989 Jeambey ..... 166/248
4,821,798 A 4/1989 Bridges et al.
4,886,118 A 12/1989 Van Meurs et al.
4,919,201 A 4/1990 Bridges et al.
5,012,868 A 5/1991 Bridges et al.
5,065,818 A 11/1991 Van Egmond
5,070,533 A 12/1991 Bridges et al.
5,099,918 A 3/1992 Bridges et al.
5,236,039 A 8/1993 Edelstein et al.
5,285,846 A 2/1994 Mohn
5,293,936 A 3/1994 Bridges
5,420,402 A 5/1995 Bridges et al.
5,586,213 A 12/1996 Bridges et al.
5,621,844 A 4/1997 Bridges
5,621,845 A 4/1997 Bridges et al.
5,664,911 A 9/1997 Bridges et al.
5,713,415 A 2/1998 Bridges
5,751,895 A 5/1998 Bridges
5,784,530 A 7/1998 Bridges
6,023,554 A 2/2000 Vinegar et al.
6,112,808 A 9/2000 Isted
6,269,876 B1 8/2001 De Rouffignac et al.
6,285,014 B1 9/2001 Beck et al.
6,360,819 B1 3/2002 Vinegar
6,596,142 B2 7/2003 McGee
6,769,483 B2 8/2004 De Rouffignac et al.
6,789,625 B2 9/2004 De Rouffignac et al.
6,929,067 B2 8/2005 Vinegar et al.
7,066,254 B2 6/2006 Vinegar et al.
7,337,843 B2 * 3/2008 Mecham et al. ..... 166/302
2003/0080604 A1 * 5/2003 Vinegar et al. ..... 299/14
2003/0098605 A1 * 5/2003 Vinegar et al. ..... 299/14
2003/0155111 A1 * 8/2003 Vinegar et al. ..... 166/59
2003/0164240 A1 9/2003 Vinegar et al.
2003/0173072 A1 * 9/2003 Vinegar et al. ..... 166/66.5
2004/0020642 A1 2/2004 Vinegar et al.
2004/0140096 A1 7/2004 Sandberg et al.
2004/0144540 A1 7/2004 Sandberg et al.
2004/0146288 A1 7/2004 Vinegar et al.
2004/0177966 A1 9/2004 Vinegar et al.
2004/0211554 A1 10/2004 Vinegar et al.
2004/0211557 A1 10/2004 Cole et al.
2004/0211569 A1 10/2004 Vinegar et al.
2005/0006097 A1 1/2005 Sandberg et al.
2005/0092483 A1 5/2005 Vinegar et al.
2005/0199386 A1 9/2005 Kinzer
2005/0269077 A1 12/2005 Sandberg
2005/0269089 A1 12/2005 Sandberg et al.
2005/0269090 A1 12/2005 Vinegar et al.
2005/0269091 A1 12/2005 Pastor-Sanz et al.
2005/0269092 A1 12/2005 Vinegar et al.
2005/0269093 A1 12/2005 Sandberg et al.
2005/0269094 A1 12/2005 Harris
2005/0269095 A1 12/2005 Fairbanks
2005/0269313 A1 12/2005 Vinegar et al.
2006/0005968 A1 1/2006 Vinegar et al.
2006/0102625 A1 5/2006 Kinzer
2007/0095536 A1 * 5/2007 Vinegar et al. ..... 166/302
2007/0133960 A1 6/2007 Vinegar et al.
2007/0187104 A1 * 8/2007 Meacham et al. ..... 166/302

OTHER PUBLICATIONS

"Power Converters" from American Superconductor website, http://www.amsuper.com, 3 pages (Dec. 2006).
"Wellbore Power Transmission For In-Situ Electrical Heating" by C.P. Stroemich, F.E. Vermeulen, F.S. Chute and E. Sumbar, AOSTRA Journal of Research, 22 pages (Jan. 1991).
Power Losses in Steel Pipe Delivering Very Large Currents by C.W. McGee and Fred E. Vermeulen, IEEE Transactions on Power Delivery, vol. 17, No. 1, pp. 25-32 (Jan. 2002).
"Novel Approach to the Synthesis of Microwave Diplexers" by Giuseppe Macchiarella and Stefano Tamiazzo, IEEE Transactions on Microwave Theory and Techniques, vol. 54, No. 12, pp. 4281-4290 (Dec. 2006).
"Physical and Electrical Properties of Oil Shale" Oral Presentation by J.E. Bridges, D.C. Kothari, R.H. Snow and G.C. Sresty, Fourth Annual Oil Shale Conversion Conference, IIT Research Institute, Chicago, Illinois, 46 pages (Mar. 1981).
"Kinetics of Low-Temperature Pyrolysis of Oil Shale by the IITRI RF Process" by Guggilam C. Sresty, harsh Dev, Richard H. Snow and Jack E. Bridges, 15th Oil Shale Symposium, Colorado School of Mines, Golden, Colorado, 13 pages (Apr. 1982).
"Promising Progress in Field Application of Reservoir Electrical Heating Methods" by R. Sierra, B. Tripathy, J.E. Bridges and S.M. Farouq Ali, 15 pages (2001).
"Backscatter," Letters to the Editor by Jack E. Bridges, IEEE Microwave Magazine, 2 pages (Dec. 2003).
"Wind Power Energy Storage for In Situ Shale Oil Recovery With Minimal $CO_2$ Emissions" by Jack E. Bridges, IEEE Transactions on Energy Conversion, vol. 22, No. 1, pp. 103-109 (Mar. 2007).
"Strategic Significance of America's Oil ShaleResource" by H. Johnson, R. Crawford and J. Bunger, Oil Shale Resources and Technology and Economics, vol. II, "Office Naval Petroleum OilShale Reserves," Washington, DC, 56 pages (Mar. 2004).
"In Situ Retorting of Oil Shale Using RF Heating: A Conceptual Design" by J.R. Bowden et al., presented at the Synfuels 5th Worldwide Symposium, Washington, DC, 19 pages (Nov. 1985).
"Net Energy Recoveries for the In Situ Dielectric Heating of Oil Shale" by J.E. Bridges et al., presented at the 11th Oil Shale Symposium, Golden, CO 50 pages (Apr. 1978).
"Economics of Shale Oil Production by Radio Frequency Heating" by R.G. Mallon, presented at the 14th Oil Shale Symposium, Golden Co., 10 pages (Apr. 1981).
"Development of the IIT Research Institute RF Heating Process for In Situ Oil Shale/Tar Sand Fuel Extraction: An Overwiew" by R.D. Carlson et al., presented at the 14th Oil Shale Symposium, Golden, CO, 9 pages (Apr. 1981).
"Design, Demonstration and Evaluation of Thermal Enhanced Vapor Extraction System" by J. Phelan et al., Sandia National Lab., Albuquerque, NM, 174 pages (Aug. 1997).
"Comparison of Dielectric Heating and Pyrolysis of Eastern and Western Oil Shale" by J.E. Bridges et al., presented at the 12th Oil Shale Symposium, Golden, CO, 13 pages (Mar. 1979).
STARS Advance Process Thermal Reservoir Simulator Version 2000, Anon, Calgary, AB: Computer Modeling Group Ltd., 2 pages (2000).
"Economic Aspects For Oil Shale Production Using RF In Situ Retorting" by J.E. Bridges and W.S. Streeter, presented at the 24th Oil Shale Symposium Record, Golden, CO, 12 pages (Apr. 1991).
"The Energy Balance of Corn Ethanol: An Update" by Hosein Shapouri et al., Office Chief Economist, Office Energy Policy New Uses, U.S. Dept. Agriculture, Washington, DC, 18 pages (Jul. 2002).
"In Situ RF Heating For Oil Sand and Heavy-Oil Deposits" by J.E. Bridges et al., presented at the UNITAR III Conf. Tar Sands Heavy Crude, Long Beach, CA, 12 pages (May 1985).
"Case Study 5: Wind Power Integration Into Electricity Systems" by Debra Justus, OECD Environment Directorate International Energy Agency, Collaboration and Climate Change Mitigation, 32 pages (2005).
"Steady As She Blows" by Peter Fairley, IEEE Spectrum Online Feature Article, 7 pages (Jul. 2006).

"Physical and Electrical Properties of Oil Shale" by J.E. Bridges, J. Enk, R.H. Snow and G.C. Sresty, Presented at the 15th Oil Shale Symposium, Colorado School of Mines, Golden, Colorado, 20 pages (Apr. 1982).
"Mathematical Model for In Situ Oil Shale Retorting by Electromagnetic Radiation" by James Baker-Jarvis and Ramarao Inguva, Department of Physics and Astronomy, University of Wyoming, Laramie, Wyoming, 54 pages (1984).
Written Opinion corresponding to co-pending International Patent Application Serial No. PCT/US2007/04708, European Patent Office, dated Aug. 29, 2008, 5 pages.
International Search Report corresponding to co-pending International Patent Application Serial No. PCT/US2007/04708, European Patent Office, dated Aug. 29, 2008, 3 pages.

* cited by examiner

ELECTRO THERMAL IN SITU ENERGY STORAGE FOR INTERMITTENT ENERGY SOURCES TO RECOVER FUEL FROM HYDRO CARBONACEOUS EARTH FORMATIONS

CROSS-REFERENCE TO RELATED APPLICATIONS

This application claims priority to U.S. Provisional Application Ser. No. 60/774,987 filed Feb. 21, 2006.

FIELD OF THE INVENTION

Background

The Problem

In 2002, the United States consumed about 20 million bbl/d of oil, about one half of which was imported. In 2025, oil consumption is expected to increase to 30 million bbl/d during a time when conventional oil sources are diminishing. To meet future needs, oil from unconventional resources, such as from the trillion barrel oil shale deposits in the USA, must be recovered.

If 10 million bbl/d of oil from the oil shale deposits were produced today by on site combustion processes, either in situ or ex situ, an additional 30% of the yearly CO2 emissions in the USA would be injected in to air. Moreover, the resulting environmental impact on the infrastructure needed, labor, housing, schools, water could be quite large.

Currently, clean power sources, such as wind and solar can not be easily utilized by the power grid because of the intermittency and reliability issues.

The Solution

One key to mitigate these impacts is to use an in situ extraction process which requires no on site combustion and utilize electrical energy to extract the oil from oil shale. For this, electrical energy could be generated at some distance elsewhere, and transported to the site via highly efficient electrical power lines. Nuclear power, solar power or wind power can provide the required energy without injecting CO2 into the air.

Because of the intermittent and highly variable nature of wind or solar power, an energy storage system of large capacity and long duration is needed to absorb excess power and retrieve the energy when needed.

Bowden (1985) Bridges (1985) describe in situ electromagnetic (EM) heating methods that can be used to extract fuel from oil shale or oil sand deposits. With changes, this past technique can be modified with additions and changes into novel EM in situ-electro-thermal energy storage method. This novel electro-thermal-energy storage method provides a way to store large amounts of thermal energy from intermittent electrical power sources, thereby acting as a shock absorber to smooth the wide variation of wind power. It also provides a method to convert the stored thermal energy back into electricity that can be used by the conventional electrical power grid. It also provides substantial additional energy in the form of gaseous and liquid hydrocarbon fuels.

The EM (electromagnetic) in situ heating methods in combination with the in situ thermal energy storage can utilize large amounts of electrical energy from wind or solar power sources; and thereby avoid the CO2 emissions that conventional oil shale extraction processes generate. This combination has the potential to economically extract fuels from unconventional deposits, such as the oil shale, oil sand/tar sand and heavy oil deposits in North America.

This novel electro-thermal storage method can rapidly or smoothly vary the load presented to the power line, either ramping up the consumption or ramping down the load, thereby serving as a load leveling function. The variable loading function can be coordinated with reactive power sources to further stabilize the grid. This method can provide the equivalent of spinning power to enhance the generation capacity into the electrical grid. The combination can be instantly interrupted and can wait days or weeks without harm before being reconnected. These functions should allow a substantial increase the in amount of intermittent power that can be accepted by the grid and also greatly improve the reliability of the grid.

Novelty

For the last few decades, regulatory and technical solutions have been sought to better utilize wind and solar power, especially to reduce green house gases. For example, a recent large international study (Debra 2005 by OECD ENVIRONMENT DIRECTORATE INTERNATIONAL ENERGY AGENCY, notes in Case Study 5 that "Two of the strongest challenges to wind power's future are the problems of intermittency and grid stability."

In a large study sponsored by the DoE (2004), Strategic Significance of the American Oil Shale Resource, Vo. II Oil Shale Resources: Technical and Economic, no mention is made of an EM/heat and energy storage concept. An in situ electrical resistance heating technology to produce shale oil was mentioned. But no discussion was presented to show how this system could be instantly interrupted or varied such that it can be integrated into the grid to improve stability or to reduce green house gases.

The March/April 2005 IEEE Power and Energy Magazine reviewed new developments and solutions for electricity storage. Surveyed included advanced batteries, flywheels, high-energy-super capacitors and pumped hydro. No mention was made of a combination of a EM/heat-and-energy storage concept.

The Weekly Feature article in the IEEE Spectrum On line public feature of August 2003 entitled "Steady as She Blows" (Fairley, 2003] reviews a number of improvements in the power electronics to enhance the stability of the grid when using wind power sources. While power electronics could help, no solutions were suggested that could act also as both a short and long term energy storage system that can return more energy than that stored.

The above Weekly Feature also notes a proposal by Apollo Energy Corporation to use a combination of electrical batteries and fuel cells. Such cells were predicted to backup a 20 MW wind farm for 20 minutes.

Data in a patent application applied for by Shell, did not consider the energy storage capabilities of an EM heated oil shale deposit, even though a large number of energy storage techniques were considered, such as pumped hydro, compressed gas, or fly wheels.

The energy storage systems noted below have not been considered to include processing in situ hydro carbon or mineral resources to recover a valuable product. Although some can store thermal energy for long periods, these are energy inefficient. Many, as currently configured, are not amenable to serve as a controllable variable load to stabilize the power grid.

Short term energy storage systems that have been considered include: Batteries, fly wheels to store kinetic spinning energy, super conducting coils to store energy within the magnetic field, ultra capacitors that store the energy in the electric fields. While these are satisfactory for small power consumption applications, these are not suitable to smooth out long term fluctuations or interruptions for large loads that consume mega watts of power. In addition, these are energy inefficient, such that the recovered stored energy is less that the energy applied.

Long term energy systems capable of smoothing out long term interruptions or fluctuations include, pumped hydro, compressed air, and thermal storage in hot water tanks or the storage of off peak energy in the form of ice for cooling large office buildings. Again, these are energy inefficient and return less energy than was initially stored.

Pumped hydro is capable of storing large amounts of off peak energy for use as peaking power during the day, but sites suitable for pumped power are hard to find, and represent a large capital investment. In addition, the turbine for the generator or for the pump, will have limited capability to compensate for large rapid changes from wind power systems. Pumped hydro shares some of the short term problems in adapting to wind power as conventional steam powered generators and power line transmission. Lastly, such systems are available to store energy in off peak periods, such as at night. These may not be available during dry spells or during the winter when the ponds or rivers are frozen.

Thermal energy storage for solar or off peak power has been stored in insulated tanks. By means of heat exchangers, these provide hot water or hot air heating for residences. Such systems are inefficient and recover the stored energy only as heat.

The electrical energy costs savings for cooling buildings are possible by making ice during off peak power times and melting the ice to cool the building during the day. These systems are energy inefficient. The refrigeration units, as currently installed, are not usually designed to continuously vary the load to compensate for intermittent power fluctuations. In addition, such facilities would not be available during the summer's day to serve as a grid stabilizing function and are not available in the winter. Further, to store large amounts of energy, requires integrating the highly dispersed facilities.

Storing thermal energy in earth formations surrounding shallow wells is being studied where the heat is transferred to an aquifer or nearby earth or stone. This process is problematic because the heat injected into the near borehole formation will diffuse into more distant formations and cannot be recovered.

Heat pumps are used for cooling in the summer and for heating in the winter. Shallow wells are used as a heat sink during the summer and as heat source in the winter. In this case, any increase in the temperature of the adjacent formations is undesirable during the summer time. While these might store enough, energy to mitigate some problems for brief intervals, these are energy inefficient and are suitable for only small amounts of energy.

SUMMARY OF THE INVENTION

The vast North American oil shale and tar sand deposits offer the potential to make the USA energy independent. However, if these deposits were produced by the existing combustion processes, substantial CO2 emissions would be injected into the air. To avoid this green house gas problem and yet produce liquid fuels, a wind powered electro-thermal in situ energy storage system is described. This invention stores the unpredictable, intermittent wind electrical energy over long periods as thermal energy in fossil hydrocarbon deposits. Because the thermal diffusion time is very slow in such deposits, the thermal energy is effectively trapped in a defined section of a hydrocarbon deposit. This allows time during the heating and storage period for the thermal energy to convert hydrocarbons into a more recoverable product. In oil sands, it is reduced viscosity. In oil shale, it is the product of pyrolysis and can include gases and liquid fuels. The recovered products have higher energy content than that consumed by the process. It can also use a portion of the produced fuel to regenerate electrical power into the electrical grid. In addition, the method can increase the reliability of the grid and provide a load leveling function.

One embodiment uses an: (1) unpredictable intermittent source of electrical power, such as wind power, in combination with a (2) conventional electrical power source that is (3) interconnected with electrical transmission lines, further (4) interconnected to conventional electrical power user and (5) also connected to unconventional electrical loads (such as the RF oil shale process) such that the unconventional load can be varied to enhance the power grid stability during (6) unpredictable power fluctuations from renewable electrical power sources or from (7) unexpected or unwanted power changes or interruptions.

Certain embodiments include methods and apparatus to: (1) apply such electrical power into the unconventional hydrocarbon resources to (2) increase thermal energy of the unconventional media and to (3) store the thermal energy in a defined region (4) over a time interval sufficient to develop valuable products and (5) recover the products with greater energy content than that consumed by the process.

This can be done by: (1) varying the electrical load by, (2) using controllable power semiconductor circuits, (3) to compensate the unpredictable fluctuations from a renewable electrical energy source, (4) to sense these fluctuations to, (5) vary the unconventional load to counter the effects of such fluctuations, thereby increasing the stability of the electrical grid, making low cost wind power available and reducing the amount of CO2 that would be otherwise injected into the air.

To implement, two different sources of a-c electrical power are considered: (1) an intermittent, low cost electrical power such as wind power, and (2) an uninterruptible and continuous but smaller source of a-c power to maintain production and site safety.

Three different sensor and control subsystems are preferred: (1) to control the application of power into the oil shale deposit by an electronically variable source of RF power for oil shale (or lower frequencies for oil sand), (2) to control the above ground apparatus, and monitor the in situ equipment to compensate for operational changes from power variations, and (3) to provide control signals from the grid to vary power applied by the RF oil shale to help stabilize the grid.

The preferred approach uses several in situ "retorts" or heating sites. These are heated sequentially, so that the peak electrical requirement for one retort does not occur at the same time as that for another retort.

If a possible electrical heating system can be disrupted by rapid disconnection or abrupt surge of power, a buffer electrical energy storage system, such as ultra capacitors, flywheels, or batteries can be used to less rapidly increase or decrease the applied power over a few minutes.

Figure 1:
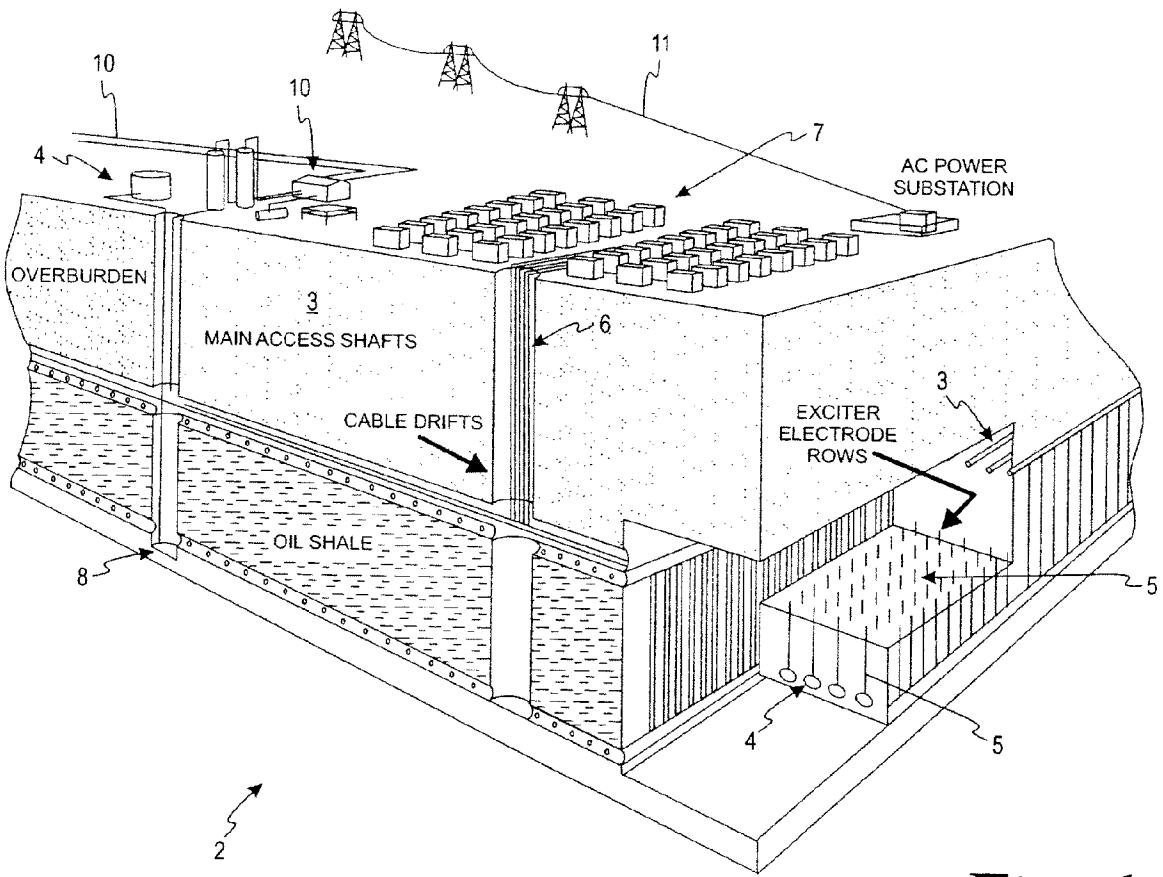
Fig. 1 (Prior Art)
FIG. 1 illustrates a conceptual design of a radio frequency heating system to recover shale oil.

ELECTROMAGNETIC (EM) OR RADIO FREQUENCY (RF)) UNCONVENTIONAL RESOURCE RECOVERY METHODS)

Unconventional resources require the application of heat to recover the oil. However, some traditional heating methods use thermal diffusion, such that heat flows by conduction from the outside to the inside of a large block of shale being heated. Thermal diffusion is a slow process and can take a long time. To speed the heat transfer, oil shale is mined and crushed before being partly burned in an above ground retort. Air quality is reduced and the spent shale pollutes the watershed. Similarly, the oil sand must be strip mined before being processed to recover the oil.

To overcome such problems, a fundamentally different in situ heat transfer method was developed using EM or RF dielectric absorption to heat the shale. Like a microwave oven, this method heats from the inside to the outside and does not encounter the "surface-to-inside" long-duration heat transfer difficulties that are inherent to the conventional retorting methods. Different frequencies are used to heat the unconventional resources, RF (radio frequencies) for shale and ELF (50/60 Hz) frequency to heat oil sand or heavy oil.

To avoid heating adjacent formations or inducing stray currents, arrays of electrodes are embedded in the oil shale in such a way that a specific volume is uniformly heated without stray radiation leakage. This leads to the most efficient use of electrical energy and helps recover about three to four barrels of oil for every oil-barrel equivalent consumed in the electrical power plant. For the electromagnetic method, little mining is required, and there is no disposal of spent shale or sand and no need for on site combustion.

The electro-thermal storage system relies on two energy storage mechanisms: (1) thermal and (2) chemical. Thermal energy is stored in situ within the heated section of the oil shale deposit. Like material in a microwave oven, the oil shale in the selected volume can be heated rapidly. Once heated, the thermal energy is effectively trapped in the selected volume for weeks or more, because thermal conduction to adjacent cooler formation takes a very long time. Provided a specific temperature is exceeded, the trapped heat can continue to pyrolize the kerogen in the shale and produce product, even if the electrical power is turned off. If the surface to volume ratio of the heated section is small, heat outflow over several weeks to months can be small.

The second storage mechanism is storing the energy in the produced gases and liquids. The energy in these products can exceed the energy needed to heat the deposit by a wide margin, and can be used to continue the heating process, should the intermittent power fail over a long period of time. This energy can be used to heat other oil shale location to a point where oil and gas are produced. These stored fuels can be used as feedstock for peaking plants and other uses as needed.

The technical feasibility and economic viability was demonstrated on a number of projects. Work on the in situ RF heating concept began in the early 1970s, and lab studies and small scale pilot test were conducted. Just before the oil price drop in the mid 1980s, a preliminary commercial scale design was developed that suggested significant advantages both economic and environmental (Bowden 1985).

Work on RF version of the EM technology work began n the early 1970s in collaboration with the DoE and Halliburton. Small scale demonstration tests were successfully conducted in oil shale and tar sand outcrops in Utah. Subsequently, the Bechtel Group developed a conceptual design for a 600 bbl/d pilot test. The Bechtel study also demonstrated commercial and environmental viability. Other independent studies, conducted at Lawrence Livermore Labs and the University of Wyoming, confirmed IITRI's results and Bechtel's data. Interest in the EM process ended when oil prices dropped in the 1980s.

Since the 1980s, considerable technical advances have occurred in power electronics, radio frequency power sources, combined cycle power plants and in computer analyses.

A preliminary commercial design was conducted by the Bechtel Group for Occidental Petroleum. (Bowden 1985). This study compared the performance of an above ground, room-and-pillar mining and retorting process with an in situ RF shale oil extraction installation capable of producing 100,000 bbl/d. The RF process improved the resource recovery, oil quality, NER and reduced the air emissions, water use and manpower. The capital costs were less that those for retorts designed in the Getty Study, or for operating retorts owned by Union Oil or Colony Oil. In 1985 dollars, the capital costs for the RF method were comparable to the capital costs for off shore deepwater installations by British Petroleum or Getty.

Further, the cost of producing the shale oil was about one-half that needed for the conventional oil shale retorting processes.

This EM heating was modified to heat in situ shallow deposits that were contaminated by hazardous oil spills. In addition to the four RF oil sand and tar sand outcrop tests, four RF in situ heated tests were conducted and two ELF tests made to evaporate hazardous chemical spills in situ. Over all, the different tests ranged in size from 1 $m^3$ to nearly 500 $m^3$, with deposit temperature ranging from 90 C for ELF heated deposits to over 400 C for RF heated formations. The ELF 500 $m^3$ test results also demonstrated an EM heating method suitable for oil sands. The five hazardous waste tests demonstrated that the RF technology could heat 200 $m^3$ blocks without major problems while at the same time recovering over 98% of the noxious products For heavy oil resources at depth, a different deep-well ELF heating technology, called EEOR (Enhanced Electromagnetic Oil Recovery) was developed. For flowing wells, it can heat out to several tens of meters beyond the well bore. It can enhance the flow rate by a factor of 2 or 3. This system was successfully demonstrated in six wells, the most notable in a field in the Netherlands, where the flow rate was increased by a factor of 2.5 and over 5,000 barrels of additional oil were recovered during the six month heating period.

The above RF and ELF applications were extensively supported by laboratory and analytical studies. Very complete data on the RF and reservoir properties (Bridges 1981) of both Western and Eastern oil shale was developed to a point where 800 $m^3$ shale field tests could be considered to demonstrate oil recovery from Western oil shale deposits.

Electromagnetic System in Situ Heating Concepts

FIGS. 1, 2, 3 and 4 illustrate the prior EM/RF systems that were proven viable in studies and field tests. These systems provided no data on how to efficiently interface with the electrical power grid to improve grid reliability issues or compatibility with intermittent electrical power sources.

FIG. 1 illustrates (Bowden 1985) a conceptual design 2 for an in situ RF shale oil recovery process. From mined shafts 3 and drifts 4, vertical bore holes 5 are formed. Next electrodes 6 are emplaced in the bore holes and connected via coaxial cables 7 to the RF power sources 8 on the surface. RF power is applied to the electrodes and the shale is heated by dielectric absorption. Interconnect voids are developed as the kerogen decomposes into oil and gas, and these voids allows the oil to flow into the boreholes and be collected in the sumps 9 near the bottom of the deposit. The produced fluids are processed n oil storage 10, upgrading facilities 11 and gas treatment facilities 12. Electrical power lines 13 transfer energy from distant generation plants.

Figure 2:
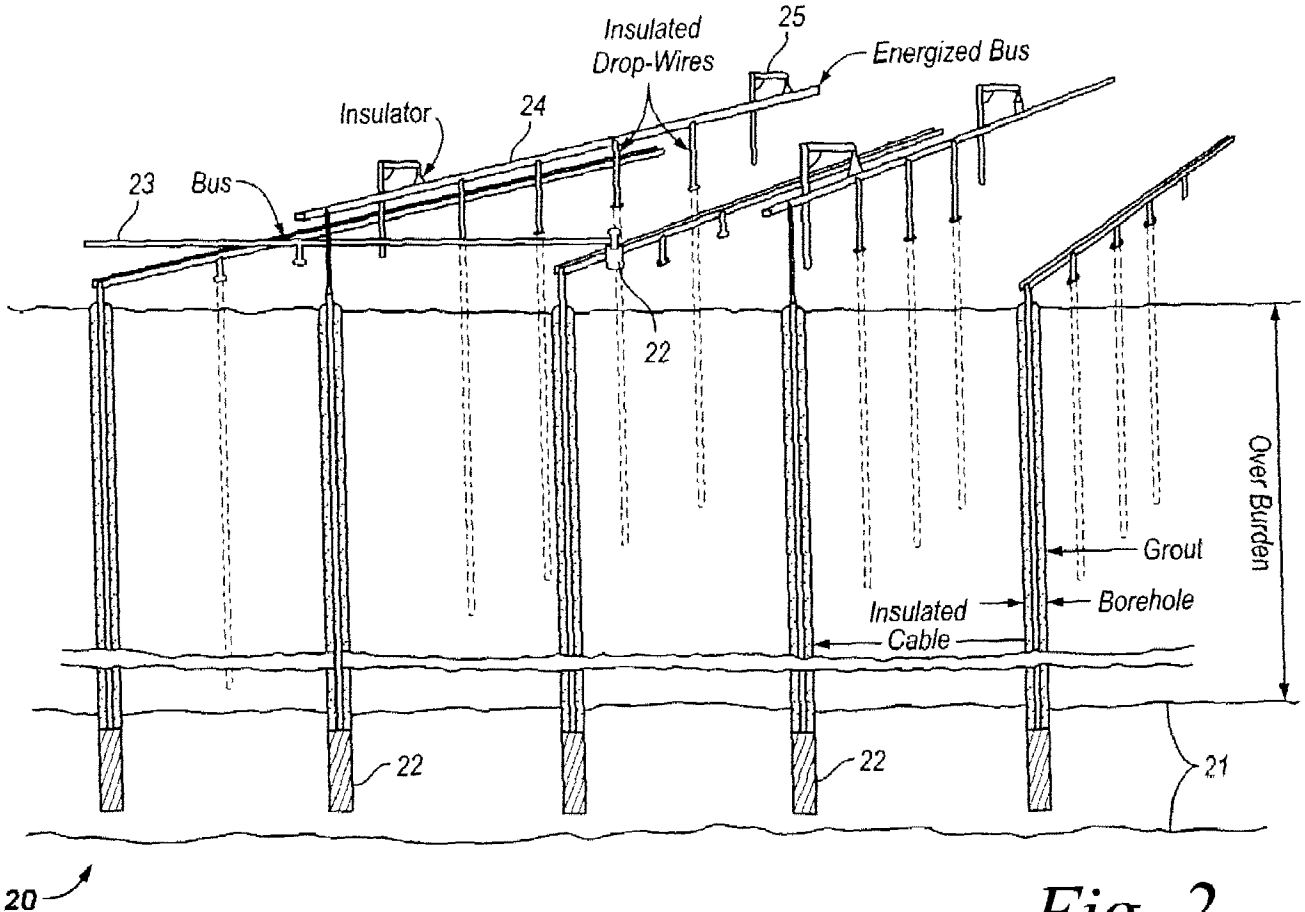
Fig. 2 (Prior Art)
FIG. 2 illustrates a conception design to heat shallow, moist oil sand deposit by low frequency 60 Hz power.

FIG. 2 illustrates a conceptual design for an in situ ELF 60 Hz conduction heating system to heat a moist near-surface oil sand deposit 21. The current from the electrodes 22 heats the deposit 21 and reduces the viscosity of the oil. This increases the mobility such that gravity drainage can be used to collect oil via collection well. Also shown are the product collection piping 23, electrical bus bars 24 and wooden support poles 25. Other production means are possible, such as following the heating by a hot water flood.

Figure 3:
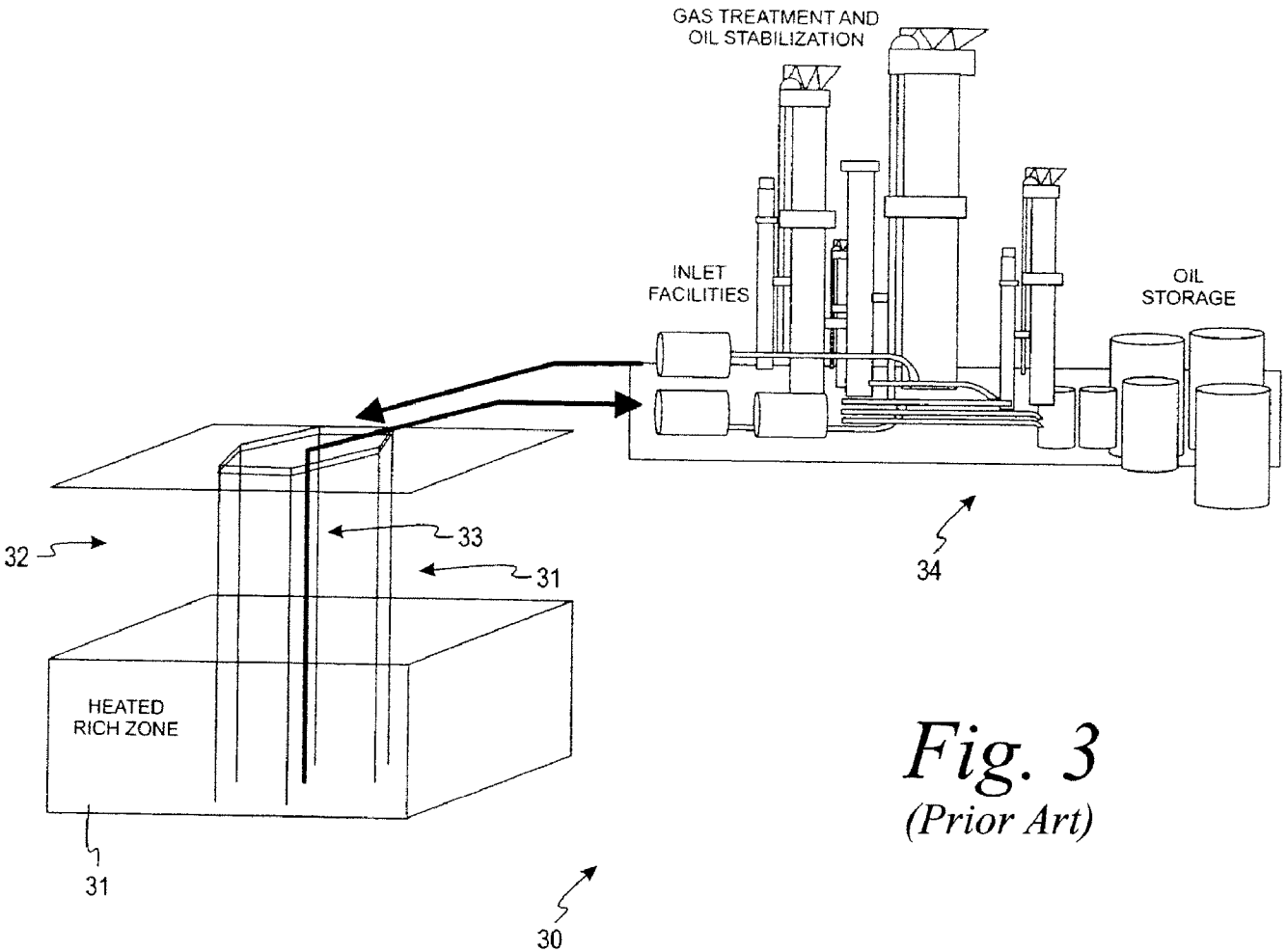
Fig. 3 (Prior Art)
FIG. 3 illustrates a conceptual design for the Shell ICP thermal diffusion process from embedded electrical heaters.

FIG. 3 illustrates conceptual design 30 for Shell Oil's ICP Process (DoE 2004). This involves drilling holes through the overburden, and placing either electric or gas heaters 31 in vertically drilled wells. The rich shale interval 33 is gradually heated over a period of several years by thermal conduction until the kerogen is converted into hydrocarbon gases and oil. These are then produced through conventional recovery means 35 and processed at surface facilities 34. Similar to the RF heating results, the quality of the recovered oil and gases is greatly improved over that for traditional methods. The ICP process avoids many of the environmental limitations found for earlier retorting methods but will require surface restoration and ground water control. The factors needed to address grid reliability or intermittent power issues are not disclosed for the ICP process.

In Shell Oil's U.S. patent application dated May 5, 2005, No. 0050092483 in paragraphs '1428 to 1431 notes that alternative or conventional electrical energy sources should be located near the hydrocarbon site (#1428). It further considers supplying power constantly to the electrical heater by drawing upon grid power during windless days (#1429). It does not recognize the thermal energy storing capability of the oil shale deposit as noted in (#1430) which follows: "Alternate energy sources such as wind or solar power may be used to supplement or replace electrical grid power during peak energy cost times. If excess electricity that is compatible with the electricity grid is generated using alternate energy sources, the excess electricity may be sold to the grid. If excess electricity is generated, and if the excess energy is not easily compatible with an existing electricity grid, the excess electricity may be used to create stored energy that can be recaptured at a later time. Methods of energy storage may include, but are not limited to, converting water to oxygen and hydrogen, powering a flywheel for later recovery of the mechanical energy, pumping water into a higher reservoir for later use as a hydroelectric power source, and/or compression of air (as in underground caverns or spent areas of the reservoir). Note that the above does not include the use of the oil shale deposit as a vehicle for storing thermal energy in context of stabilizing the grid and while supplying some of the electrical energy from wind power.

Figure 4:
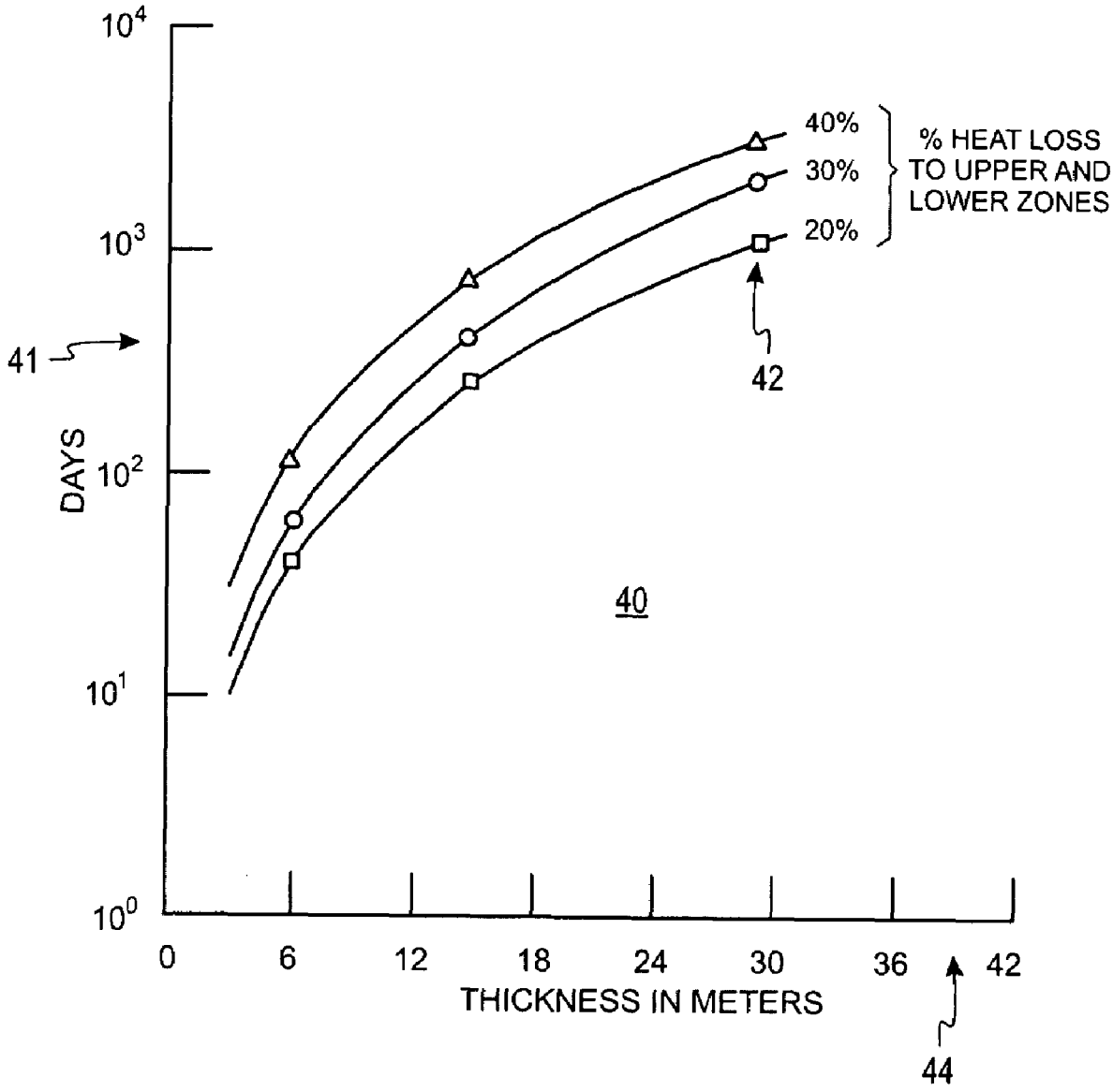
FIG. 4 shows the vertical thermal loss for a stratified representative petroleum reservoir.

FIG. 4 illustrates 40 how long thermal energy can be stored in a representative stratified heavy oil site. This shows the percentage heat loss 42 in days 41 as a function of the thickness 44 of the deposit. These data show that the heat can be trapped in the deposit for some time for typical deposit thicknesses, such as 100 days for 20% heat loss for a 12 meter thick deposit.

Figure 5:
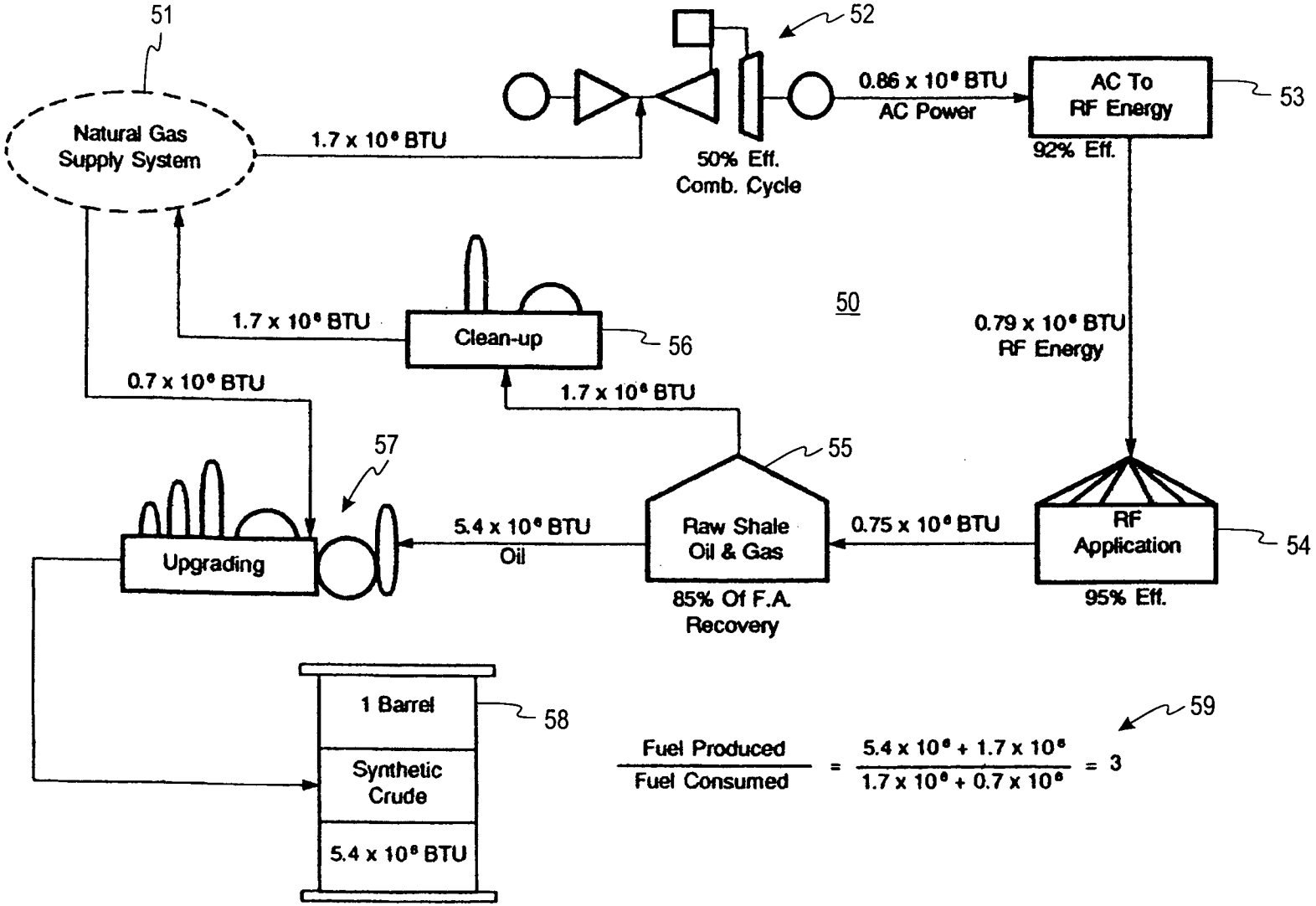
FIG. 5 describes the energy flow for a gas fired combined cycle electrical power source to heat by RF absorption and recover fuel from an oil shale deposit.

FIG. 5 of the Bechtel study illustrates a functional block diagram of the RF in situ shale oil extraction process. This relates the energy input to the energy output based on state of the art equipment performance such that $1.7\times10^6$ btu/bbl is needed to generate the electrical power, and about $1.7\times10^6$ btu/bbl of the produced gases are used to upgrade the product to a high quality syncrude. With upgrading to produce a very high quality syncrude, the NER (the ratio of the energy recovered to the energy consumed in the power plant) is about 3. Shown are a natural gas supply system 51, a combined cycle gas fired generator 52, an radio frequency power source 53, an in situ electrode RF applicator 54, a production collection subsystem 55, a high btu gas clean up subsystem 56, a shale oil upgrading subsystem 57 and a barrel 58 showing the collected synthetic crude. Equation 59 shows how the NER is calculated from the data in the FIG. 5.

Figure 6:
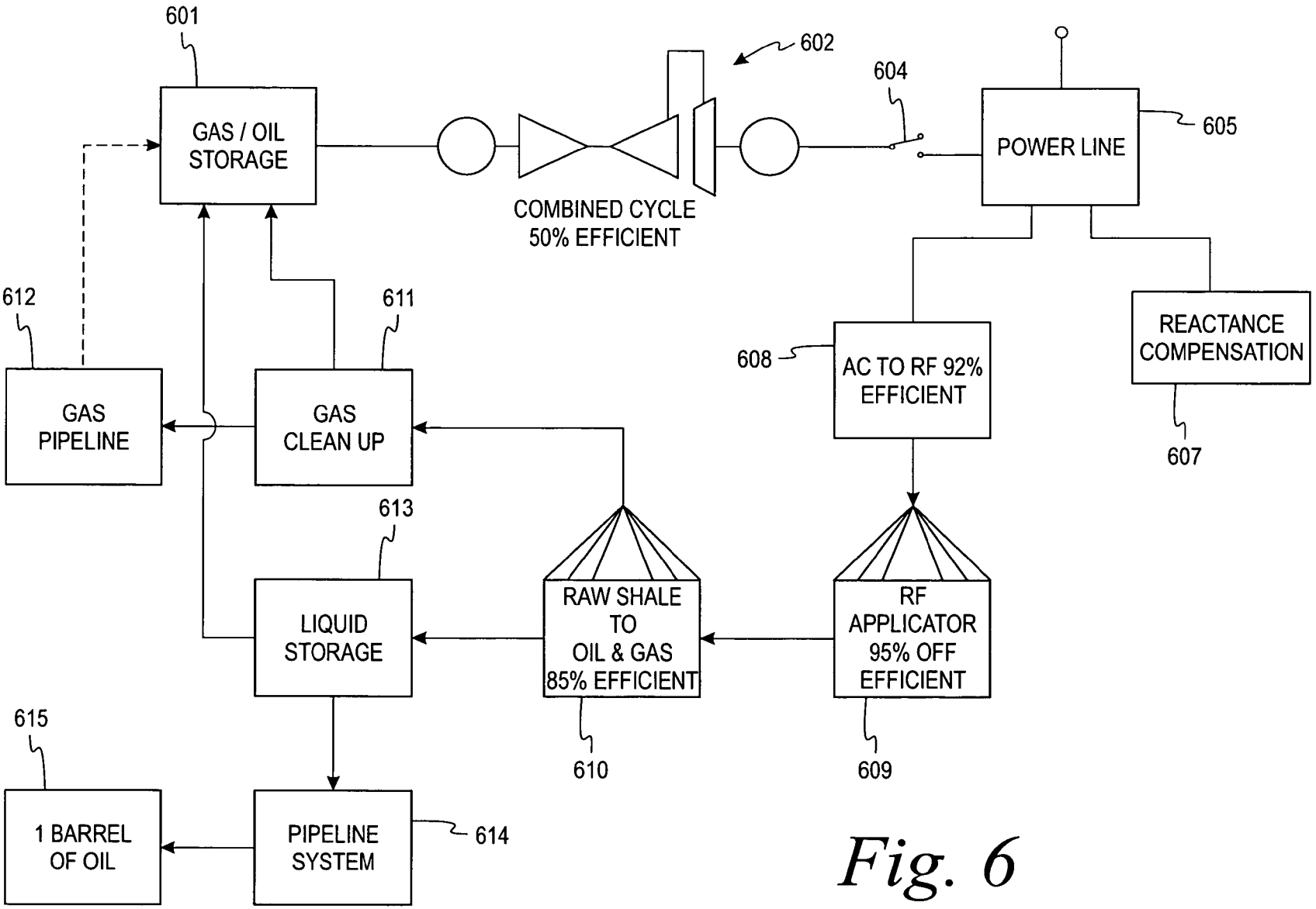
FIG. 6 shows a functional block diagram that integrates the system of FIG. 5 into the electrical grid and product recovery pipelines and storage.
Figure 7:
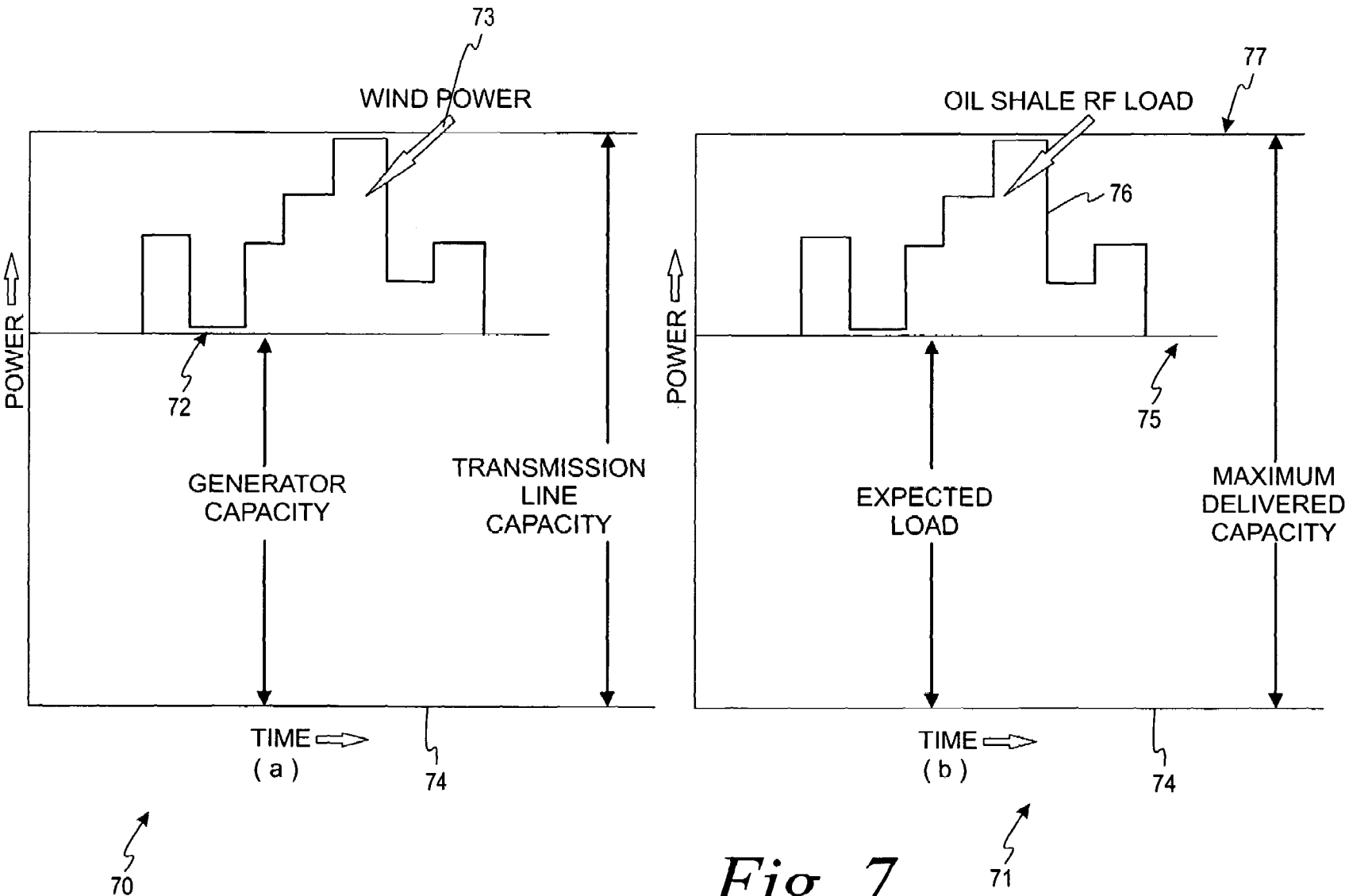
FIG. 7*a* shows the time history of the output capacity from a conventional generator, wind power generator and transmission line.
FIG. 7*b* shows the time history of the expected load, the RF oil shale load and the maximum power line delivery capacity.
Figure 8:
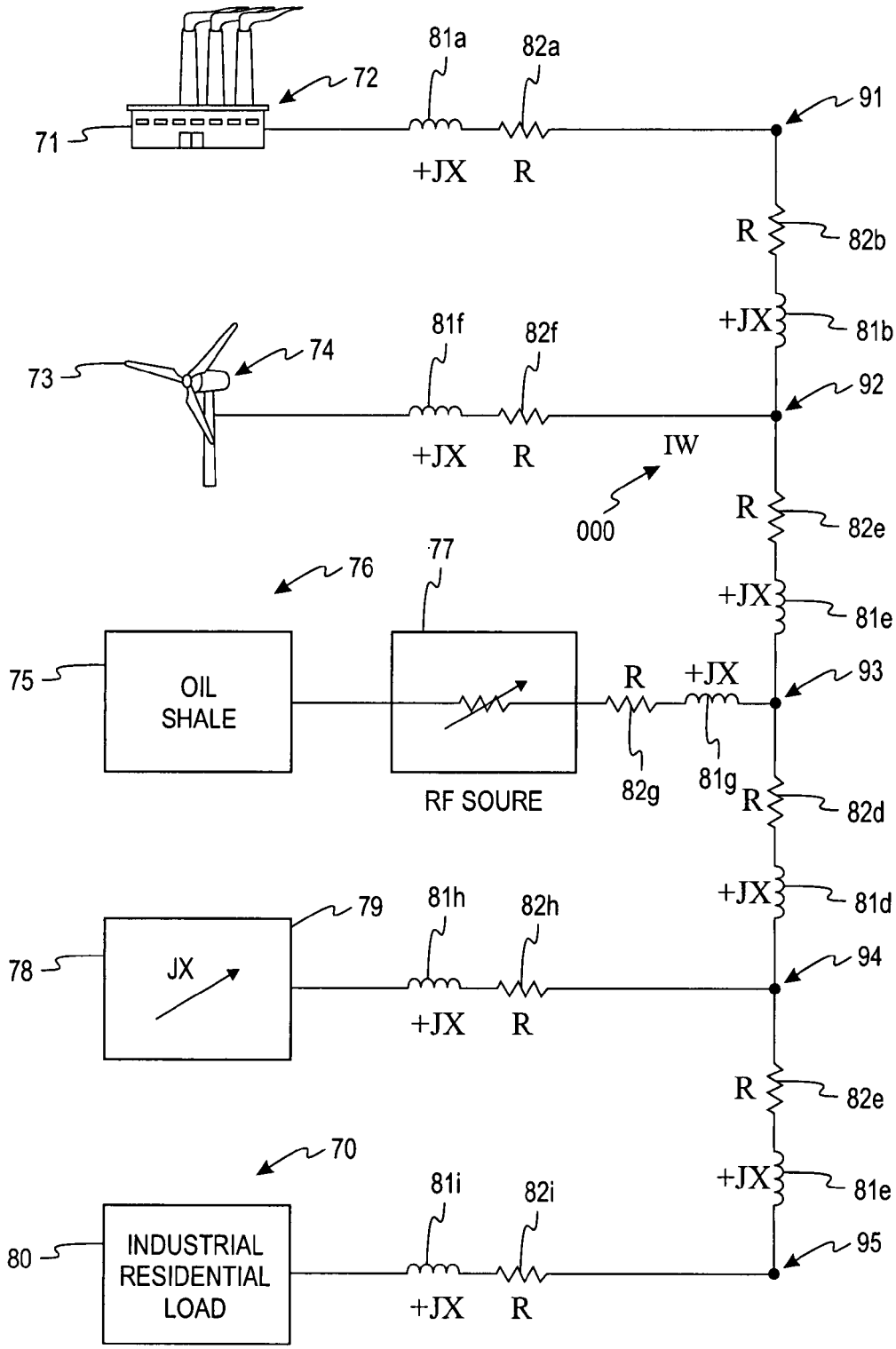
FIG. 8 shows a simplified combination of conventional and wind power sources with reactive compensation, commercial loads and RF oil shale load.

FIGS. 6, 7, and 8 illustrate some of the novel features of one embodiment. FIG. 6 is designed to illustrate several different modes of operation: Case I illustrates the traditional hook up where all power is furnished by a conventional steam generators. Case II considers furnishing both conventional and wind power simultaneously via a conventional transmission line. Case III illustrates an energy storage system with a net energy gain. Case IV considers the use of the RF in situ wind power technology in a remote area.

To consider the different cases, FIG. 7 shows how the wind power fluctuations can be compensated, and FIG. 8 shows how this method can be incorporated into an operating grid.

FIG. 6 is similar to FIG. 5, except functions needed to understand how grid reliability and intermittent power are added. Here, the high btu gases are considered as an output product rather than being used to upgrade 34.4 API raw shale oil. Such high API fuel needs little upgrading. This increases the NER FIG. 5 from 3 to 4.

In FIG. 6, a gas and oil storage facility 601 provides fuel for a combined cycle electric generator 602 that supplies power to a power line 605 as needed by switch 604. Various subsystems are shown, the power line 605, a power electronic reactance compensation 607, an a-c to RF power source 608, an in situ RF energy applicator 609, a product collection subsystem 610, a gas clean up subsystem 611, a gas pipeline 612, a liquid storage tank 613, and an oil pipeline 614 that carries oil 615.

The ability to vary the load to offset unpredictable changes originated within the grid, is illustrated in FIGS. 7*a* 70 and 7*b* 71. In FIG. 7*a* are the generation capacity 72 and the transmission line capacity 73. Other unpredictable changes in line power are illustrated as wind power 73, all a function of time 74. In FIG. 7*b* the expected load 75 and the maximum delivered capacity 77 as a function of time 74 are also shown. Note that the oil shale load 76 can be varied to match the increase or decrease in wind power 73.

FIG. 8 includes a number of subsystems: a conventional steam powered electric generator 71, a related sensor subsystem 72, a wind powered electric generator 73 and related sensor subsystem 74, a RF oil shale facility 75-77 and related sensor 76, an adjustable load control subsystem 77, an electronic reactance control subsystem 78 and sensor subsystem 79, an industrial and residential load 80 and sensors subsystems 70. Nodes 91, 92, 93, 94, and 95 form connection points respectively for the steam generator 71, the wind generator 73, the RF load control subsystem 77, the electronic reactance control 78, and an industrial and residential load 80. The resistors 81*a*-81*i* and inductors 82*a*-82*i* characterize the real and inductive series impedance between the nodes and various power sources and loads.

Sensors include but not limited to measurements of the following: voltages, currents, power factors, power flow direction, frequency and phase relationships. In addition to sensors unique to the steam power, wind power and solar power sensor, additional sensor measurements may be made at each node of the transmission line system.

To illustrate, Case I, the traditional 60 Hz power line connection is considered without the use of a wind power generator. As shown in FIG. 5, the power for the process is obtained from a conventional AC 60 Hz power grid. Grid reliability can be improved by increasing or decreasing the power used by the RF oil shale facility.

This feature could, in time of need, rapidly reduce the power consumption of the AC to RF power source in an amount equal to or greater than the amount of extra power generation capacity needed (spinning power) to supply additional power without firing up additional back up boilers, as illustrated for wind power in FIG. 7*a*. The addition of the nearly instantaneously variable RF load, as shown in FIG. 7*b*, makes additional continuous power instantly available to other customers that was other wise reserved as spinning power, such as for an unexpected increase in the power delivery requirements. These allow more efficient utilization of the generation capacity of the electrical grid. The electro-thermal energy storage allows great flexibility to compensate the effects of unexpected changes in the operation of the grid and conventional electric power generation requirements.

Also in emergency, the power to the AC to RF could be reduced rapidly or abruptly to disconnect the load presented to the grid.

By closing switch 604 shown in FIG. 6, this arrangement can supply emergency power over weeks or months of time. For either peaking or emergency power, the generator could be fueled from ongoing production or by stored gas or liquids produced from the oil shale process. Neither the generator nor the gas or oil storage facilities need to be close to the site. Piping and power lines would be used to connect the more distant equipment with the site.

Case II considers combining intermittent power from wind, solar or similar sources with the traditional grid that includes 50/60 cycle steam generators, fixed voltage transmission lines and transformers and conventional loads from commercial and residential users. For this to work, the variable power output from such generators can be mitigated by the use of thermal energy storage, even over days when the wind does not blow. When needed inductive reactance compensation can be applied.

This method of rapidly reducing or increasing the RF power consumption, in combination with rapidly changing (either inductive or capacitive) the reactive power can add additional stability to the grid, especially for wind power sources. Such a power electronic systems are manufactured by American Superconductor.

As a load leveling function, the RF electronics can rapidly or smoothly increase or decrease the load in response increasing or diminishing supply of wind power in response to a given power transfer, voltage regulation or reactive power criteria. Because thermal energy can be stored for some time, this combination can operate during long periods of little wind or high wind energy.

As noted earlier, FIGS. 7*a* and 7*b* illustrate a simplified case where a wind powered generator supplies power into the grid as shown in FIG. 8. FIG. 8 shows a representative combination of a steam electrical generator 71, a wind power generator 73, an RF oil shale facility 75, an electronically variable RF load 77, an inductive reactance compensation function 78 and an industrial load 80. Each of these loads are connected to a power line via a line connection. Each line segment has its own series resistance 81 and inductance 82. Similarly each node on the power line is separated by a series resistance 81 and inductance 82. Sensors are located at the steam turbine plant 72, the wind generator 74, the oil shale load 76, the inductive reactance compensation function 79 and the industrial load 70. Sensors at each of the nodes 91, 92, 93, 94, and 95 may also be used. The output from each of the sensors 72, 74, 76, 78, and 70 are monitored and are used to control the operations so as to prevent grid disruption from unpredictable wind power or other unplanned situations.

Power electronics packages could supply either leading or lagging reactive power, The combination of the power electronic reactive power control and the RF load modification capability allows additional opportunities to optimize grid performance while at the same time utilizing wind power. For example consider FIG. 8 which shows a conventional steam powered synchronous generator 71 that energizes a transmission line connected to an asynchronous wind generator 73, a variable resistive load 77 from an RF oil shale facility 75, a power electronic reactance correction source 78 and the conventional industrial and residential power load 80. As a first order compensation, the increase in wind generator real current should be matched by a comparable increase in the current to the RF source. Similarly, any increase in the inductive reactive current, from wind power generator should be matched by a comparable increase in capacitive reactance current.

Assume that the wind power is increased. Intuitively, this will tend to decrease the torque and current for the synchronous generator and will tend to increase the output voltage and frequency. The factors for a rigorous optimization of grid performance would include the real time measurements of the torque or phase shift of the synchronous generator, the amplitude and phase of the various line voltages and currents and the reactive power sources, such as the asynchronous or synchronous wind generators and the voltage/current consumption of the RF source and the reactive or real current generated by the power electronic subsystem. Traditional sensors can be used to develop data on such parameters, process such data and display these to control the operation of the grid system.

In many cases, the load may not have to absorb entirely each and every increase in wind power, nor reduce completely a load reduction to compensate for a reduction in wind power.

Solar power costs are becoming more completive and be integrated into the grid, much the same way wind power can be accommodated. Other sources of intermittent power can also be used, such as power generated from ocean waves or tides.

In the case of the systems shown in FIG. 1, a number of independent RF power sources are used. Rather than design each independent RF source with a variable load function, groups RF generator can be progressively or collectively turned on or off to match, in small increments, the overall power consumption to the available wind power. This allows the RF generators to operate at the most efficient power settings.

A similar approach can be used for the other multi-source systems.

Case III Considers an Intermittent Energy Storage System or Synthetic Battery with a Net Gain The arrangement shown in FIG. 6 can be configured and operated as a synthetic storage-battery function by closing switch 604. In this example, the combined cycle generator does not have to be located near the oil shale site. For FIGS. 5 and 6, consider a power line 605 energized by a variable power source such as wind, connected to supply energy $0.86\times10^6$ btu/bbl to the RF generator 608. Following the process flow in FIG. 5, this intermittent energy is stored as thermal energy in the oil shale 609. And, over a period of time, this heat generates $5.4\times10^6$ btu of oil and $1.7\times10^6$ btu of gas. This oil can be stored in a tank 613 or pipeline 614. The initial applied energy can be recovered in electrical form by using the high btu gas to fuel the combined cycle generator to recover the initial $8.6\times10^6$ btu input via the connection to the power line 605. An additional $5.4\times10^6$ btu/bbl in liquid fuel is also recovered for an overall net energy gain of 3 times. Note that the widely varying wind power peaks and valleys are now smoothed and appears as clean electrical power for direct use into the grid. Note that this long term battery smoothing function relies mostly on the thermal energy storage in the deposit but the chemical energy storage in gas and liquid fuel storage can supply fuel to the combined cycle generator 602 to supply three times the power that was initially consumed.

The synthetic battery concept may be useful to store off peak energy from traditional generation sources. The benefit depends on the cost difference between the value of the traditional fuel consumed and the value of the produced liquids and gases. It may be beneficial in keeping steam generators operating to counteract the effects of a sudden demand. During spring floods, hydroelectric plants may have excess capacity that could be converted into a more valuable fluid fuels.

Case IV RF Extraction in Remote Regions

The use of a wind power to energize RF extraction system in a remote region is possible. Here access to existing traditional 50/60 Hertz, fixed voltage power lines may not available. Such traditional 50/60 Hz lines could be used, with a dedicated fixed voltage 50/60 Hz wind power generator and a dedicated 3 phase power line and a dedicated electronic controllable subsystem that matches the power consumption of the load to the power output of the wind generator.

Other configurations may be more economic. For example a d-c output wind and d-c transmission line can be considered. Rather than using a fixed a-c voltage, the wind generator could provide a variable d-c voltage output into a d-c transmission line. At the RF load location, d-c to d-c and d-c to a-c to power electronics subsystem could be used to supply the proper current and voltages to the RF variable load. Conventional a-c pump motors and electronic subsystems may require fixed voltages and 60 Hz frequency. Such an arrangement may be less costly in certain situations. For example, the use of a single wire and grounded return d-c transmission line could be less costly than fixed line voltage and set frequency 3-phase power lines, for d-c line voltage in the order of a few kilovolts and power consumption less that a few megawatts. Two wire d-c transmission lines can be used where a common ground return concept is not appropriate. Applications where Case IV apparatus may be suitable to heat mineral deposits to increase the solubility for value minerals.

Other Considerations

Figure 9:
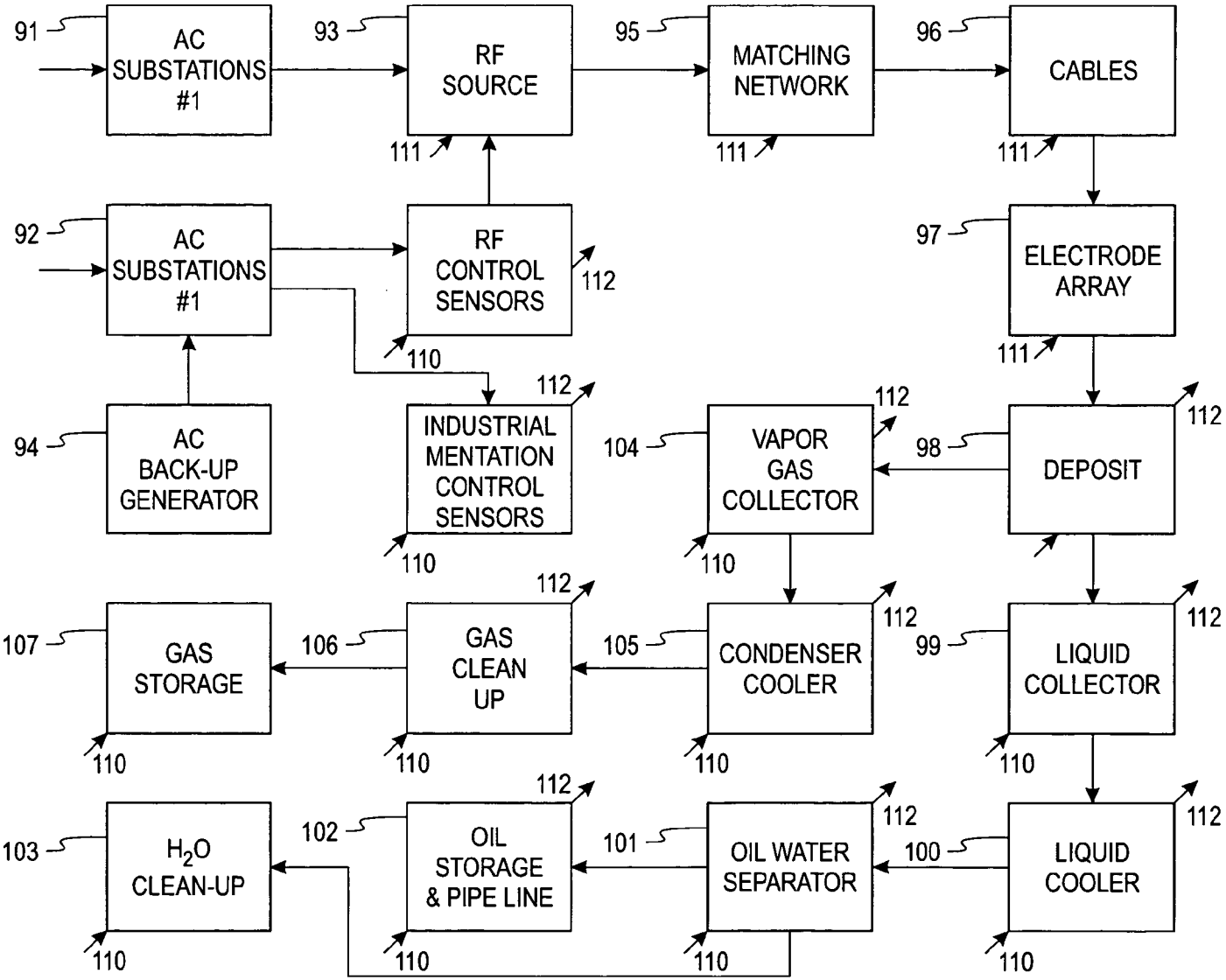
FIG. 9 shows a functional block diagram for an RF shale oil extraction process as integrated into the instrumentation, electrical grid and pipe lines.

The RF load can only be reduced to a point where critical equipment must be kept operating. The a-c line power cannot be reduced to zero. Even if the RF power is turned off, the oil shale will continue to produce oil shale gases, vapors and liquids. These products must be collected and processed, whether or not the RF power is on or off. FIG. 9 shows two substations, one 92 of which is dedicated to supplying uninterrupted power and the other 91 to supply interruptible power to the RF source 93. Provision is made for an emergency generator 94 to provide critical power in the event of a major transmission line outage.

If the heating power is reduced or augmented to compensate for the variations in the wind power, functions other than the RF generator may have to be modified. For example, the pumping rate of fluids may be reduced or increased, or the cooling water rate for the RF source modified. The feed water rate into a steam generator can be varied in concert with the variations in RF load. These and other features have to be incorporated to allow variable load to function without disrupting other apparatus.

The example in FIG. 9 is presented to demonstrate some of the modifications needed. In the RF circuit a matching network 95, to compensate for impedance variations presented to the connecting cables 96 by the electrode array 97 embedded in the oil shale deposit 98. Liquid collection subsystems 99 and liquid cooler 100 provide cooled liquids to the oil water separator 101. The separated oil is sent to storage and pipe line facilities 102 and separated water is sent to a water treatment subsystem 103. Vapors and gases are collected by a vapor collection subsystem 104. These vapors are cooled by a condenser 105 and the separated gases are sent to gas clean up 106 and thence to gas storage and pipelines 107.

Uninterruptible power from 92 is supplied to functions that monitor the status of the equipment and for functions that must continue to process the collected gases and liquids, such as temperature, pressure and flow rates. The power related instrumentation subsystems are needed for voltage, current, real power, reactive power, phase, such as suggested in FIG. 8, FIG. 9 notes by diagonal arrows: (1) the various ac power consuming functions, (2) sensors and instrumentation needed to control the RF heating process, such as radio frequency, cable voltages and current and standing wave ratios for the matching circuits, (3) sensors for process instrumentation, such as temperature, pressure, fluid flow and levels.

A diagonal arrow 112 from the right upper corner of the function blocks indicates a need to make process control measurements. A diagonal arrow 110 to the lower left of the function box indicates and a-c power requirement. An arrow 111 on the lower middle part of the function block indicates where RF data measurement sensors are used.

To even out production and power consumption, a possible full scale version would sequentially time the heating of selected blocks. In the case of both tar sands and oil shale, production occurs during the later phases of heating and may persist for some time after the heating has been terminated.

The heat loss due to thermal diffusion during heat up or during a time when the system is turned off can be estimated, as approximated shown in FIG. 4. More accurate data can be developed, based on the geometry of the heated zone, the thermal properties of the heated zone and adjacent layers; the heat losses can be calculated using computer reservoir programs (See Stars 2000). The thermal properties of shale for this are described in Bridges 1981. Tolerable heat losses to adjacent formation preferably should not exceed 25%.

Electrical Power Requirements

The electrical power requirements for production rates needed to supply a given number of barrels per day based on FIG. 4 data is noted below.

| Production bbl/d | conventional power required | Number of 5 MW wind generators |
|---|---|---|
| $10^5$ | 1 GW | 20 to 40 |
| $10^6$ | 10 GW | 200 to 400 |
| $10^7$ | 100 GW | 2000 to 4000 |

The 100 GW needed to produce about 10 million bbl/d is about 1.4% of the 2005 power generation capacity for North America. The installed wind power capacity in 2004 was 6.7 GW or roughly 1% of the total generation capacity in North America.

These data show that utilization of wind power is not out of reach but may require state of the art transmission lines, such as EHV d-c transmission to isolate the location of the power generators away from the shale oil production site. Also careful integration of the wind power system with both the in situ RF oil shale extraction facility and the traditional power generation and transmission methods is required.

Electrical Equipment

Power Electronics can be used in the RF source, such as shown in FIG. 8, to very efficiently vary the RF power by converting the 3-phase a-c line voltage to a d-c voltage that supplies power to the radio frequency power generation circuits. By very efficiently varying the voltage on the d-c buss, the output power of the RF generator can be varied over a wide range while at the same time presenting a variable load to the power line. This load can be varied in accordance to the intermittent power available or to perform other functions, such a load leveling. Examples for high efficiency controllable a-c to d-c circuits have been well known for sometime and are discussed in handbooks, such as Electrical Engineering handbook by Dorf published by CRC press 1993 in Section 29. Commercial designs for high efficiency high power a-c to d-c converters are commercially available at American Superconductor, which offers such equipment commercially in 100 kW packages that have maximum conversion efficiencies of 98% for full power. These packages may use IGBT (Insulated Gate Bipolar Transistors) in switching circuits.

Commercially available broadcast and short wave transmitters can be modified to supply RF power for frequencies in the range of 30 kHz to 150 MHz. The RF output can be increased or decreased as needed by varying the input power to the radio frequency output stages. The use of high efficiency modern semiconductor devices and circuits are available for this function. Example include the use of MOSFET (Metal Oxide Field Effect Transistors) semiconductor devices for used in on-off type switching circuits.

In the case of Shell's ICT process that uses embedded electrical resistors to heat the oil shale deposit by thermal conduction, heating times in the order of several years are expected. Subject to any design limitation, the load presented to the power line can be varied according to the power available from intermittent and other sources. American Superconductor offers controllable 3-phase a-c to single (or multiphase) a-c converters that can supply variable power to the array of embedded resistors. The load presented to the power line can be smoothly varied by the a-c to a-c converters either in accordance with the intermittent power available or for some other function, such as load leveling.

Robust electrical tubular heaters that can be inserted into an unconventional hydrocarbon deposit have been designed to withstand wide input power variations, such as needed for the RF wind powered electro-thermal method. This design is described in pending patent application Ser. No. 11/655,533 entitled Radio-Frequency Technology Heater for Unconventional Resources.

American Superconductor also makes a dynamic reactive power compensation subsystem, 'D-VAR' D-VAR allows wind farms to meet utility interconnection requirements such as low voltage regulation, power factor correction, such as discussed with FIG. 7 for a controllable –jX function. The D-VAR equipment is usually located near the wind generators.

In the case of the ELF power frequency heating system shown in FIG. 2, American Superconductor can furnish 3-phase a-c to single (or multiphase) controllable a-c outputs. As described above, the power consumption can be varied to accommodate intermittent or other sources of power. The electrodes inject current into the deposit and this heats the deposit volumetrically similar to that observed for RF dielectric absorption. This heating reduces the viscosity and increases the mobility of the oil. This oil can be produced by gravity drainage system using a horizontal producing well. Hot water flood can also aid in the production. The heated in situ volume can retain heat for long periods of time. Similar to the RF oil shale examples discussed in FIGS. 6, 7, 8, and 9, the different process and recovery steps have to be sensed and the pump motor rates varied or cycled a and constant electrical power supplied to critical functions.

Other oil recovery systems that introduce heat into large deposits can be modified to use intermittent electrical power. Bridges (1995) notes that heavy oil well production can be stimulated by electrically heating the formation by an electrode embedded in the heavy oil deposit. Electrical power for this is obtained from a controllable electronic power conditioner that converts three phase power into single phase power which is used to heat the near well bore region in the heavy oil deposit. This method stores the heat near the well bore even while producing. If the well is not operated, the stored heat can last for a few weeks or more. However, if the well is produced during periods when electrical heating is absent, the heat in the deposit will be partially recovered in a few days via convection in the heat contained in the produced fluids. This near-well bore formation heating system can be used to heat water being injected into the formation near the well bore, for hot water floods. Using methods discussed for the oil shale, the electro-thermal intermittent energy storage method can be used to control the load presented by the electrical power source to the power line.

Hot water or steam floods are used to enhance heavy oil production. The electro-thermal energy storage method can be used to make wind and solar power effective for such deposits. Heavy oil deposits in California are produced by injecting hot water or steam. In the past, the water was heated by burning the produced oil. In the case of the heavy oil deposits in Southern California, the burning of the recovered high-sulfur content oil created severe air pollution. For some of these California reservoirs, intermittent electrical energy could be used to heat the injection water; thereby storing the heat within the reservoir without impairing grid reliability or significantly reducing the oil recovered. The energy used for the injection water rate would have to be reduced or increased in proportion to the energy available from the variable load presented to the power line.

Other applications include heating mineral formations to increase the solubility of valuable minerals when using an in situ water flood. In these cases, the heat is translated into a valuable product. Electrically heating thermally insulated piles of gold ore undergoing a leaching process to recover the gold might benefit by increasing the temperature of the pile. Such processes, either in situ or ex situ can accept widely varying electrical power.

A major advantage of the electro-thermal energy storage method is that the CO2 emissions from the production of oil from future unconventional reservoirs can be substantially reduced, while not significantly affecting the in situ recovery of oil and gases. Also water contamination and surface disturbance can be reduced for many of current oil extraction process in Canada where strip mining and hot water extraction methods are used. This method can be applied to recover in situ many of the heavy oil or oil sand reservoirs even though these are widely dispersed. By means of communication links and high voltage transmission lines, isolated electro-thermal production facilities can be integrated to operate under a unified grid control plan.

Definitions:

An intermittent source is from renewable power source, such as wind, and solar. Conventional or traditional electrical power sources include electrical generators that are energized by conventional fuel or energy, such as coal, natural gas, oil, nuclear fuels or hydroelectric plants.

Unconventional media or resources include hydrocarbon deposits, such as oil shale, oil sand, tar sand and other petroleum deposits or those that require in situ heating to extract the fuel. Unconventional electrical loads are apparatus that converts electrical energy into thermal energy by varying the power absorbed in unconventional media to compensate for unpredictable fluctuation in the power from intermittent sources by increasing absorption during periods of peak intermittent power and decreasing the absorption when the intermittent source wanes.

Electromagnetic (EM) is a generic term for the electric and magnetic fields. The terms includes Extra Low Frequencies (ELF) band includes 30 to 3000 Hz or power frequencies. The term Radio Frequencies (RF) as used here means any frequency used for dielectric heating or absorption, and typically would include frequencies from 30 kHz to 3 GHz so as to include microwave heating effects

The invention claimed is:

1. A method of heating at least a part of a subsurface earth hydrocarbon formation containing valuable constituents, comprising forming a opening into said formation, heating said formation with power transferred into said opening from an electrical power grid connected to multiple sources of electrical power that include at least one source of electrical power that exhibits intermittent power changes, heating said hydrocarbon formation to store thermal energy in said formation over a time interval sufficient to develop a recoverable fluid fuel in said formation, and recovering an amount of said fluid fuel having an energy content greater than the energy consumed in the heating of said hydrocarbon material, withdrawing valuable constituents from said formation via said opening, and varying the load on said power grid to at least partially compensate for the effects of said intermittent power changes on said power grid.

2. The method of claim 1 in which said sources of electrical power that exhibit intermittent power changes comprise a wind power source.

3. The method of claim 1 in which said sources of electrical power that exhibit intermittent power changes comprise a solar source.

4. The method of claim 1 in which the said intermittent power changes are caused by changes in the expected operating parameters of said grid.

5. The method in claim 1 in which said intermittent power changes are caused by unexpected power delivery requirements.

6. The method of claim 1 in which said heating is controlled by controllable power semiconductor circuits that respond to fluctuations in a power source connected to said power grid and vary the heating of said valuable constituents to at least partially compensate for said fluctuations.

7. The method of claim 1 in which additional thermal energy is stored in gases and liquids in said valuable constituents withdrawn from said formation.

8. The method of claim 1 in which said formation is oil sand and said heating is effected with power from a low frequency electronically variable source connected to said power grid.

9. The method of claim 1 in which said formation is heated in a plurality of different sites that are heated sequentially so that the peak electrical requirements for the different sites are not synchronous.

10. The method of claim 1 in which rapidly changing electrical energy is stored in at least one buffer electrical energy storage system selected from the group consisting of ultra capacitors, flywheels and batteries.

11. The method of claim 1 in which said formation is a hydrocarbon formation.

12. The method of claim 1 in which said formation is oil shale and is heated over a time interval and to a temperature sufficient to convert a portion of the formation into a valuable fluid.

13. The method of claim 1 in which said formation contains a viscous oil and is heated to a temperature sufficient to reduce the viscosity of said fluid to a point where a portion of the heated fluid can be recovered.

14. The method of claim 1 which includes heating said hydrocarbon formation with two sources of electrical power, one that supplies power that includes an intermittent source, and the other that supplies a continuous, uninterruptible source of electrical power to maintain production and safety.

15. The method in claim 1 which includes employing 1) sensor systems to control the application of power to the valuable formations by an electronically variable load, 2) sensors to control above ground equipment and 3) sensors to provide control signals from the grid to vary the electronically variable load in response to variation in the power from an intermittent source.

16. The method of claim 1 in which above ground equipment is controlled to adjust the processing rates of the above ground equipment to compensate for operational changes caused by variations in the power applied to the deposit.

17. The method of claim 1 which includes injecting water into said formation, and said heating includes heating the injected water to store heat within said formation.

18. The method of claim 17 wherein the heating rate and time interval of said heating are sufficient to recover valuable mineral.

19. The method of claim 1 in which said formation is a heavy oil deposit that is heated in situ by steam that is vaporized by power from an electronically variable source included in said multiple sources of electrical power.

* * * * *